US005689867A

United States Patent [19]

Katz

[11] Patent Number: 5,689,867

[45] Date of Patent: Nov. 25, 1997

[54] INTERCHANGEABLE CLASP

[76] Inventor: Teresa Katz, 153 W. 93rd St., New York, N.Y. 10025

[21] Appl. No.: 724,604

[22] Filed: Sep. 30, 1996

[51] Int. Cl.[6] ..... A44B 17/00; A44C 5/14

[52] U.S. Cl. ..... 24/589; 24/265 B; 24/265 WS; 24/616; 24/356; 63/1.1; 63/1.17

[58] Field of Search ..... 24/589, 616, 633, 24/640, 630, 669, 702, 697.1, 13, 356, 573.5, 644, 653, 612–617, 265 EC, 265 WS, 265 B; 63/1.1–1.17, 20, 21, 23, 42, 43, 33

[56] References Cited

U.S. PATENT DOCUMENTS

| | | | |
|---|---|---|---|
| 2,051,591 | 8/1936 | Brogan | 24/116 |
| 2,113,786 | 4/1938 | Garfinkel | 24/616 |
| 2,169,461 | 8/1939 | Darvie et al. | 63/1.17 X |
| 2,266,074 | 12/1941 | Rauer | 24/616 |
| 2,586,758 | 2/1952 | Zerr | 24/116 |
| 2,956,324 | 10/1960 | Klein | 24/702 X |
| 3,360,836 | 1/1968 | Geldwerth | 24/616 |
| 3,850,010 | 11/1974 | Noto | 24/265 B X |
| 3,939,534 | 2/1976 | Hayes | 24/265 B |
| 4,414,719 | 11/1983 | Capolupo | 24/265 B X |
| 4,486,925 | 12/1984 | Lineberry | 24/518 |
| 4,527,316 | 7/1985 | Murphy | 24/616 |
| 4,564,308 | 1/1986 | Ikegami et al. | 24/265 WS X |
| 4,648,161 | 3/1987 | Rosen | 24/702 X |
| 4,665,595 | 5/1987 | Viot et al. | 24/616 |
| 4,958,420 | 9/1990 | Bunz | 24/616 X |
| 5,005,268 | 4/1991 | Hartmann | 24/265 WS X |
| 5,410,784 | 5/1995 | Katz | 24/589 |
| 5,412,850 | 5/1995 | Miranda | 24/616 |
| 5,416,953 | 5/1995 | Hui | 24/265 WS |

FOREIGN PATENT DOCUMENTS

| | | | |
|---|---|---|---|
| 483621 | 4/1938 | United Kingdom | 63/1.1 |
| 713826 | 8/1954 | United Kingdom | 24/702 |

*Primary Examiner*—Peter M. Cuomo
*Assistant Examiner*—Robert J. Sandy
*Attorney, Agent, or Firm*—Lieberman & Nowak, LLP

[57] ABSTRACT

An interchangeable clasp comprising a clasp body having a plurality of interconnecting elements consisting of a spring loaded connector member and a receiving recess. The connector typically comprises a hollow cylindrical sleeve and a rigid rod having an outside diameter less than the inner diameter of the hollow cylindrical sleeve. The rigid rod has a proximal end and an opposite distal end with respect to the hollow cylindrical sleeve. The proximal end is engaged with a spring mechanism within the hollow cylindrical sleeve that biases the distal end of the rod to a distal position and allows for movement of the rod between a proximal and a distal position. The distal end culminates in a head member with exterior dimensions such that the head member is capable of being removably inserted within, and retained by a cap end of the receiving recess. The receiving recess is cylindrical in dimension, has an opening through its outer wall and is capped at opposite ends for engaging the connector.

6 Claims, 4 Drawing Sheets

INTERCHANGEABLE CLASP

FIELD OF THE INVENTION

The subject invention relates to an interchangeable clasp which can be used with belts, pocketbooks, purses, handbags, satchels and jewelry such as necklaces, bracelets, pins and the like.

BACKGROUND OF THE INVENTION

Clasps having two receptacle ends for use in securing string jewelry are known. For example, Brogan, U.S. Pat. No. 2,051,591, issued Aug. 18, 1936, teaches a connecting member which uses a pressed up portion to exert biasing tension to hold a ball ended shank at the end of a piece of string jewelry in place.

A similar device was described by Rauer, U.S. Pat. No. 2,266,074, issued Dec. 16, 1941, which provides a clasp having a means for quickly changing the number and style of strings relative to the clasp. Similar to the Brogan clasp, the Rauer clasp uses a spring fastener to secure the string to the clasp.

Zerr, U.S. Pat. No. 2,586,758, issued Feb. 19, 1952, describes a jewelry chain connector with opposing side notches in which a plurality of chains can be interlocked. The connectors of Zerr may also utilize a fastening projection to form a brooch.

Another variation on a clasp for holding multiple chains or strings of jewelry is described by Lineberry, U.S. Pat. No. 4,486,925, issued Dec. 11, 1984. Lineberry's design uses a plurality of connecting members attached to a single clasp. Similarly, the jewelry chainstay of Murphy, U.S. Pat. No. 4,527,316, issued Jul. 9, 1985, can be used for attaching multiple ornamental chains to a single clasp. Other patents dealing with similar subject matter include Viot, et al., U.S. Pat. No. 4,665,494, issued May 19, 1987, Geldwerth, U.S. Pat. No. 3,360,836, issued Jan. 2, 1968, and Garfinkel, U.S. Pat. No. 2,113,786, issued Apr. 12, 1938.

U.S. Pat. No. 5,410,784, issued on May 2, 1995 to Katz, the applicant of the subject invention, related to a jewelry clasp having a generally cylindrically shaped connector which fits within a recess having a marginally larger volume and retaining means for keeping the connector in place.

SUMMARY OF THE INVENTION

The subject invention provides an interchangeable clasp which comprises a clasp body having a plurality of interconnecting elements consisting of a spring loaded connector member and a receiving recess. The connector member typically comprises a hollow cylindrical sleeve and a rigid rod having an outside diameter less than the inner diameter of the hollow cylindrical sleeve. The rigid rod has a proximal end and an opposite distal end with respect to the hollow cylindrical sleeve. The proximal end is engaged with a spring mechanism within the hollow cylindrical sleeve that biases the distal end of the rod to a distal position and allows for movement of the rod between a proximal and a distal position. The distal end culminates in a head member with exterior dimensions such that the head member is capable of being removably inserted within, and retained by a cap end of the receiving recess. The receiving recess is cylindrical in dimension, has an opening through its outer wall and is capped at opposite ends for engaging the connector.

In one preferred embodiment of the present invention the clasp body has a connector member on opposing edges of the clasp body. The connector members are removably inserted within receiving recesses attached to opposite ends of a necklace strand or belt.

DETAILED DESCRIPTION OF THE INVENTION

The following description is of the preferred embodiments of the subject invention. These embodiments are set forth to provide a better understanding of the subject invention, but are not to be construed as limiting.

The subject invention relates to an interchangeable clasp which can be used with jewelry (necklace, bracelets, pendants, pins, etc.), belts, pocketbooks, purses, handbags, satchels and the like. Typically, the clasp is decorative in nature and may be adorned in any manner known to those skilled in the art.

The choice of material from which the clasp can be crafted will vary based on aesthetics and on the materials to which the clasp is to be affixed. By way of example, a clasp in accordance with the present invention to be used with costume jewelry may be crafted from any suitable base metal which could be shined, burnished or electroplated to provide a decorative look. Similarly, for elegant estate jewelry, a clasp could be made from a precious metal such a platinum, gold or silver an may be adorned with one or more stones. Of course the clasp could be formed from any suitably rigid material, such as a polymeric resin, plastic, graphite, metal, wood, stone, bond, shell or the like.

In the embodiment illustrated in the figures shown, stones 101 have been mounted in clasp body 100 and may be held in place by any known means. Other means of decoration are within the skill of the artisan. Since jewelry is an ancient and well developed art, the selection of materials, sizes, compositions, ornamental patterns, etc. are obvious, and accordingly will not be discussed in detail.

Figure 1:
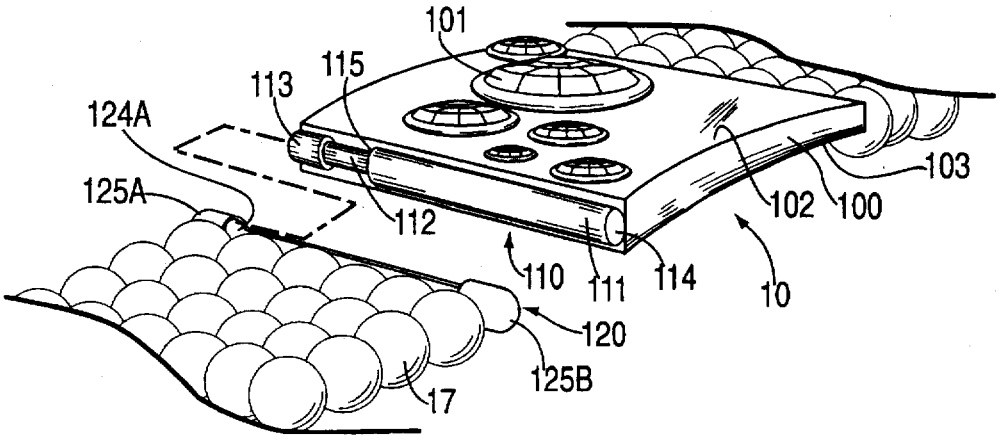
FIG. 1 is a perspective view of one embodiment of the subject invention.
Figure 2:
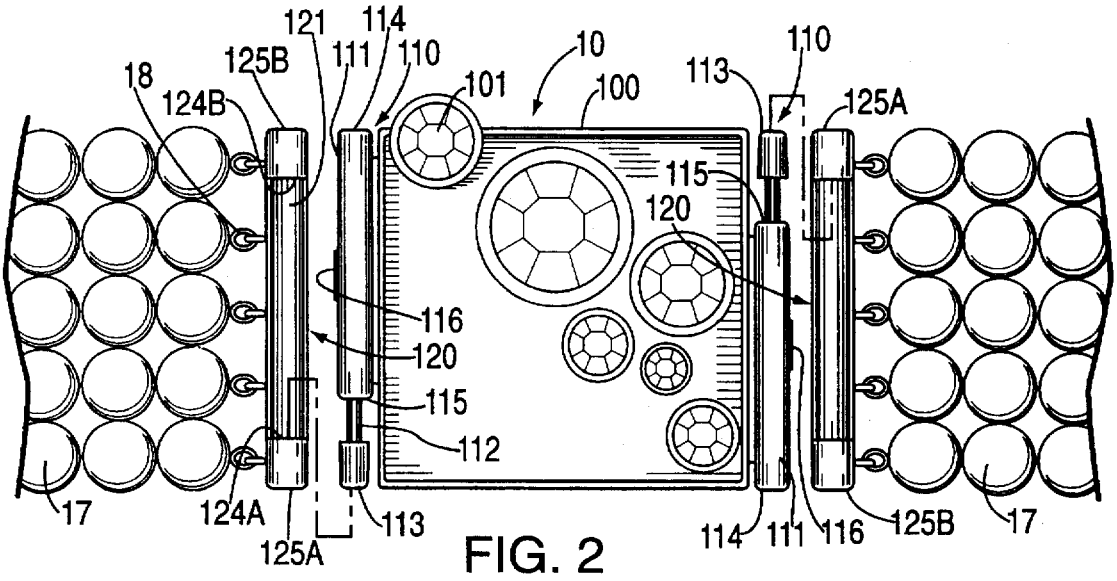
FIG. 2 is a top view of the embodiment of the subject invention of FIG. 1.

Referring to FIGS. 1 and 2, clasp 10 comprises clasp body 100 and two connector members 110 connected at opposite edges of clasp body 100 by any suitable manner known to those skilled in the art, like soldering. Connector members 110 comprise: a hollow cylindrical sleeve 111 closed at end 114 and open at end 115; a rigid rod 112 slidably positioned within hollow cylindrical sleeve 111 with a distal end extending from within hollow cylindrical sleeve 111, through said open end 115; and a head member 113 attached to said distal end. A spring mechanism (not shown) positioned within hollow cylindrical sleeve 111 enables relative movement between rigid rod 112 and hollow cylindrical sleeve 111 such that said distal end of rigid rod 111 can be moved from a position proximal to said open end 115 to a position distal to said open end 115. Connector members 110 are configured generally as cylinders so as to slidably fit within receiving recess 120. The term "cylinder" as used in the subject application is to mean any elongated three dimensional shape. Examples of such shapes include, but are not limited to, triangular prisms, quadrilateral prisms, pentagonal prisms, hexagonal prisms, cones, etc.

Receiving recess 120 is defined by a hollow cylinder whose outer wall 121 only partially envelops the circumference and full length of the cylinder leaving a longitudinal opening through which one of the connector members 110 can be inserted. At opposite ends of the hollow cylinder of receiving recess 120, caps 125A and 125B, respectively, are formed by outer wall 121. The inner diameter of receiving recess 120 is designed so that a connector member 110 can slidably fit therein. Preferably, the fit between connector member 110 and receiving recess 120 is such that relative movement between them is minimized when they are engaged. Preferably, when fully extended, connector member 110 has an exterior volume substantially identical to or slightly smaller than the interior volume of receiving recess 120.

Figure 3B:
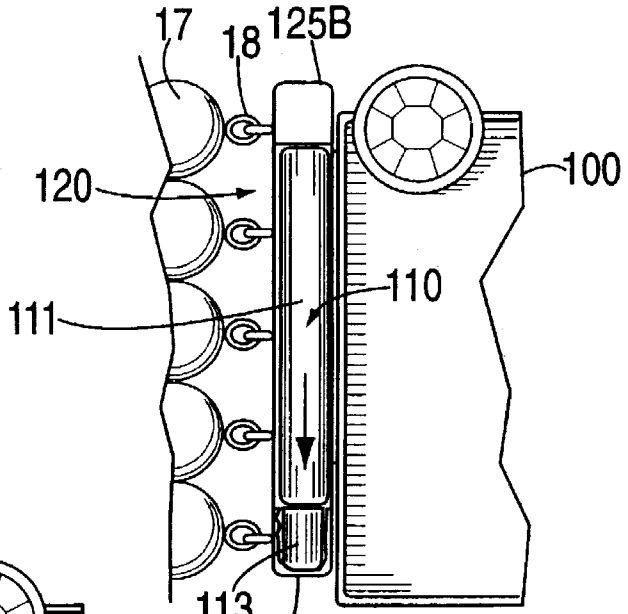
FIGS. 3*a*–3*c* illustrate the coupling of the connector member and the receiving recess of the subject invention.
Figure 3C:
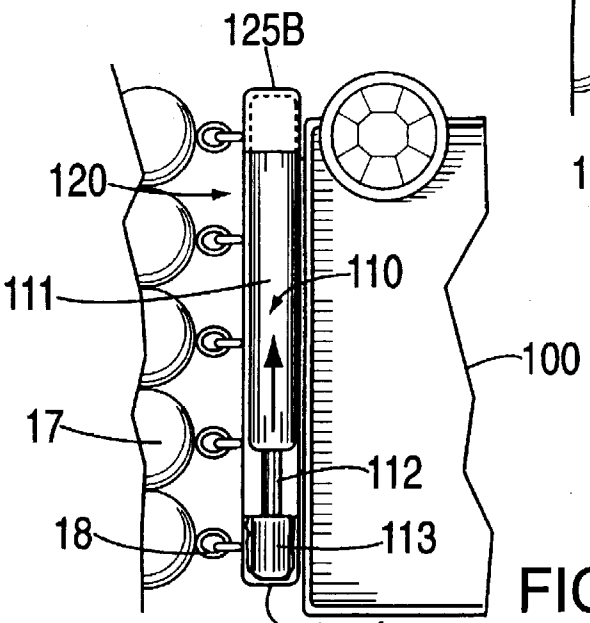
Figure 3A:
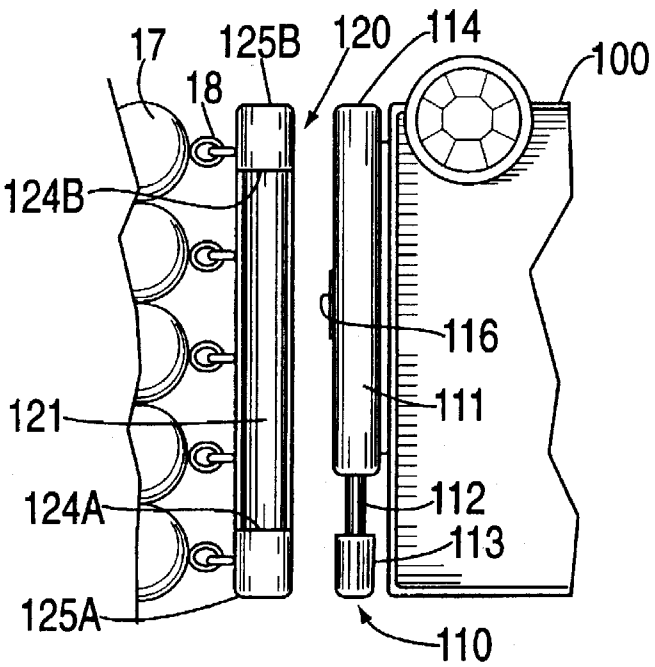

The coupling between connector member 110 and receiving recess 120 is illustrated in FIGS. 3*a*–3*c*. In FIG. 3*a* connector member 110 and receiving recess 120 are shown as separate elements. To couple the connector member 110 with receiving recess 120, head member 113 is first inserted within receiving recess 120 and guided through open end 124A of cap 125A. Hollow cylindrical sleeve 111 is subjected to a force toward head member 113 so as to compress the spring mechanism therein (not shown) until the closed end 114 of hollow cylindrical sleeve 111 clears open end 124B of cap 125B. In this regard it should be noted that the length of circumferential walls of caps 125A and 125B should be designed with a length not greater than the difference between the length of receiving recess 120 and connector member 110 in its fully compressed state, defined as where rigid rod 112 is in its most proximal position relative to hollow cylindrical sleeve 111. At this point the entire connector member is inserted within receiving recess 120. The force on hollow cylindrical sleeve 111 is released, causing rigid rod 112 to extend under bias of the spring mechanism (not shown), to its distal position. As a result, closed end 114 passes through open end 124B of cap 125B and becomes engaged within cap 125B. As mentioned previously, the fit between connector member 110 and receiving recess 120 should be such that relative movement is minimized when they are engaged. Therefore, the full length of receiving recess 120 should be at least slightly smaller than the length of connector member 110 and the length of the smaller of cap 125A or cap 125B.

As shown in FIGS. 1–3 and 5 clasp 10 may be coupled with a strap, string of beads or the like, chain, etc., generically referred to herein as length 17, where length 17 is attached by means 18 well known in the art, to: a connector member 110 on one end and a receiving recess 120 on an opposite end; two connector members 110 on opposing ends; or two receiving recesses 120 on opposing ends. In other words, length 17 includes a set of connecting elements consisting of connector member 110 and receiving recess 120, that is complimentary to the set of connecting elements on clasp 10.

Figure 4A:
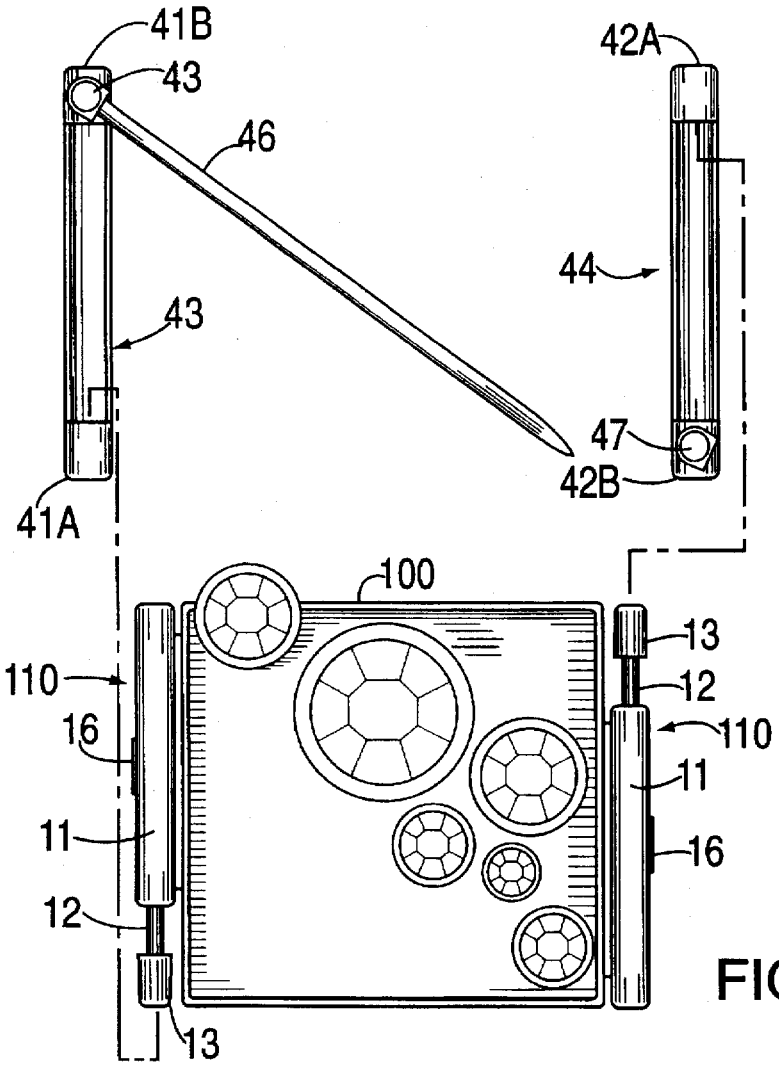
FIGS. 4*a* and 4*b* are top views of one application of the subject invention wherein the clasp body is connected to a brooch structure.
Figure 4B:
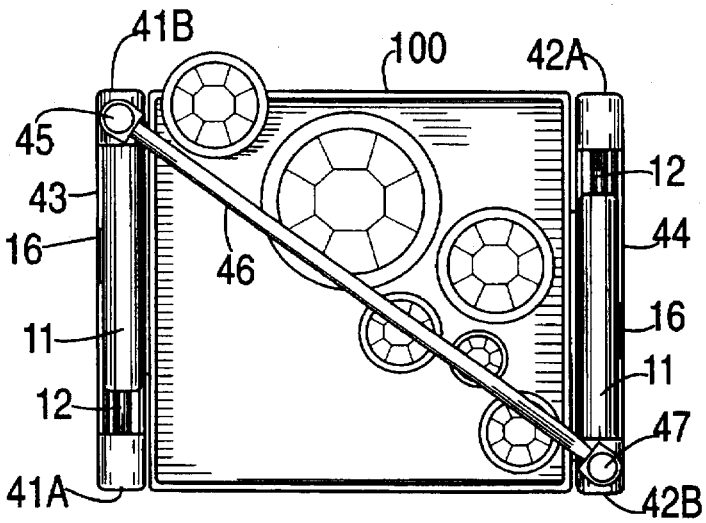

Referring to FIGS. 4*a* and 4*b*, a second application of the subject invention is shown wherein clasp 10 is coupled to a brooch structure for affixing clasp 10 to an object such as a shirt, blouse, skirt, satchel, etc. The brooch structure comprises a first receiving recess 43 and a second receiving recess 44 to engage connector members 110 of clasp 10 as previously described. Receiving recesses 43 and 44 are substantially identical to receiving recess 120, differing only to the extent necessary to provide for the functionality of a brooch. More specifically, receiving recess 43 is connected to a pin 46 at the outside wall of cap 41B with connecting means 45, well known in the art. Receiving recess 44 includes a pin receiving means 47 well known in the art on cap 42B. When engaged one connector member 110 of clasp 10 is inserted within receiving recess 43 through cap 41A and the other connector member 140 is inserted within receiving recess 44 through cap 42A. The orientation of connector members 110 and receiving recesses 43 and 44 when engaged is such that pin 46 traverses the back 103 of clasp body 110.

Although not depicted, clasp body 110 may include any number of receiving recesses 120 into which connector member 110 may be inserted. For necklace applications, this number is typically two. For brooch applications, this number will typically be from one to four.

Receiving recesses 120 and connector member 110 may be used for securing additional connector members 110 and receiving recesses 120, respectively, having decorative features attached thereto.

Figure 5A:
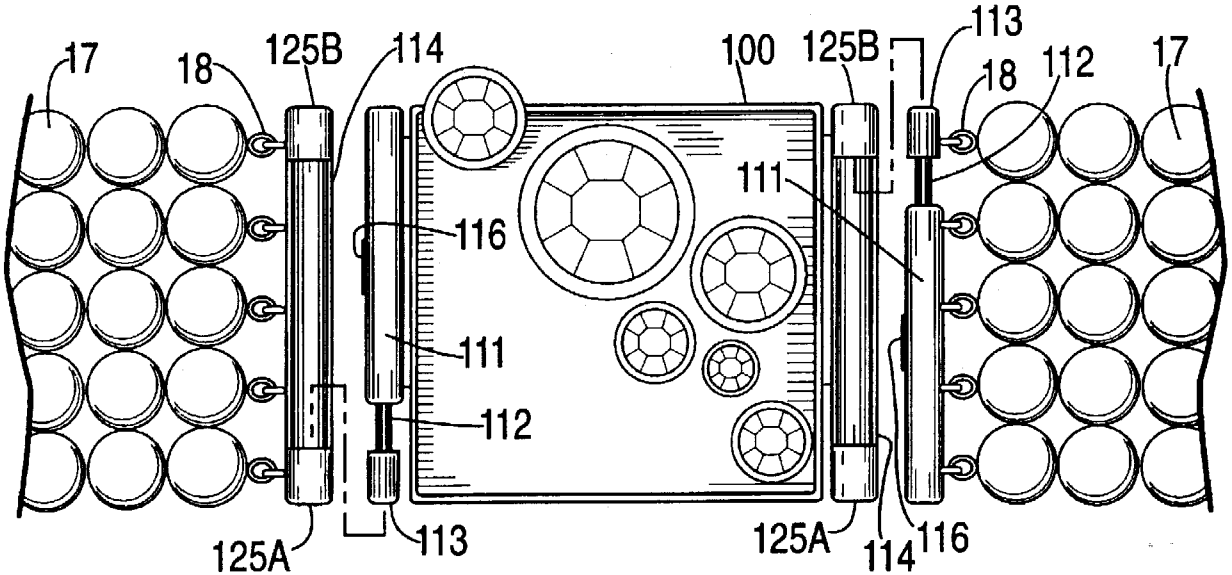
FIGS. 5*a* and 5*b* are top views of a second embodiment of the subject invention wherein the clasp body is attached to one connector member and one receiving recess.
Figure 5B:
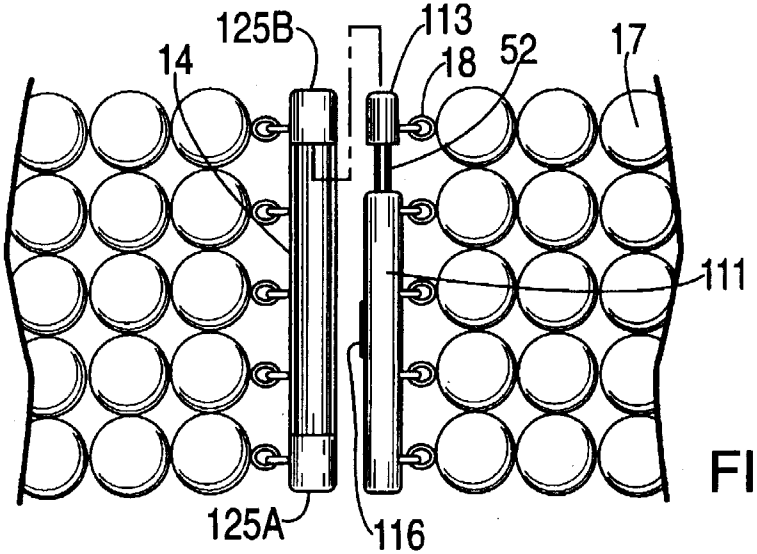

FIGS. 5*a* and 5*b* show a second embodiment of clasp 10 of the subject invention having one connector member 110 and one receiving recess 120 attached to opposing sides of clasp body 100.

The interchangeable clasp 10 permits a single clasp to be used in multiple applications and is designed to be aesthetically pleasing to the eye while enhancing the overall design of the item to which it is affixed. For example, clasp 10 may be used at one time to join one or more strings of jewelry, (e.g. one end of a necklace to the other, one end of a bracelet to the other, or necklace to necklace and/or bracelet to bracelet, to change length), at a subsequent time to secure two ends of a belt and another time to be worn as a brooch. In all cases, the clasp provides decoration, structure and the artistic and economic advantage of being transferable from one item to another. The later advantage becomes obvious when one considers that three chains and three clasps affords nine necklaces, i.e. by mixing and matching. Accordingly, the subject clasp is both ornamental and multifunctional.

Upon reading the subject application, numerous variations and alternative embodiments will become obvious to those skilled in the art. These alternative embodiments are to be considered within the scope and spirit of the subject invention. The subject invention is only to be limited by the claims which follow and their equivalents.

What is claimed is:

1. An interchangeable clasp comprising:

a clasp body; and a plurality of connecting elements attached to said clasp body, said connecting elements selected from the group consisting of a connector member and a receiving recess, said connector member comprising a hollow cylindrical sleeve having one closed end and one open end, a rigid rod having a proximal end slidably mounted within said hollow cylindrical sleeve, and an opposite distal end extending through said open end, and biasing means for biasing said distal end of said rigid rod toward a distal position and allowing for movement of said rigid rod between a proximal and a distal position relative to said hollow cylindrical sleeve, and said receiving recess being cylindrical in dimension, having an opening to its exterior, and having a cap at each of its opposite ends for removably engaging said connector member when inserted through said opening and within said caps.

2. An interchangeable clasp according to claim 1 wherein said connector member further comprises a head member attached to said distal end of said rigid rod, configured so as to removably fit within one of said caps of said receiving recess.

3. An interchangeable clasp according to claim 1 wherein said clasp body is attached to one connector member and one receiving recess.

4. An interchangeable clasp according to claim 1 wherein said clasp body is attached to two connector members.

5. An interchangeable clasp according to claim 1 wherein said clasp body is attached to two receiving recesses.

6. A brooch structure comprising:

a first connecting element having a pin attached thereto; and a second connecting element having pin receiving means attached thereto, said first and second connecting elements selected from the group consisting of a connector member and a receiving recess, said connector member comprising a hollow cylindrical sleeve having one closed end and one open end, a rigid rod having a proximal end slidably mounted within said hollow cylindrical sleeve, and an opposite distal end extending through said open end, and biasing means for biasing said distal end of said rigid rod toward a distal position and allowing for movement of said rigid rod between a proximal and a distal position relative to said hollow cylindrical sleeve, and said receiving recess being cylindrical in dimension, having an opening to its exterior, and having a cap at each of its opposite ends for removably engaging said connector member when inserted through said opening and within said caps.

* * * * *